US011602211B2

(12) United States Patent
Chae et al.

(10) Patent No.: US 11,602,211 B2
(45) Date of Patent: Mar. 14, 2023

(54) STORAGE POUCHES AND GRAY HAIR COVERAGE METHOD USE

(71) Applicant: Kiss Nail Products, Inc., Port Washington, NY (US)

(72) Inventors: Sung An Chae, Levittown, NY (US); Arina Lee, New York City, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 17/352,128

(22) Filed: Jun. 18, 2021

(65) Prior Publication Data

US 2021/0393020 A1 Dec. 23, 2021

Related U.S. Application Data

(60) Provisional application No. 63/041,696, filed on Jun. 19, 2020.

(51) Int. Cl.

| | |
|---|---|
| ***A45D 40/24*** | (2006.01) |
| ***B65D 85/72*** | (2006.01) |
| ***B65D 33/01*** | (2006.01) |
| ***B65D 25/42*** | (2006.01) |
| *A45D 19/00* | (2006.01) |

(52) U.S. Cl.

CPC ..... *A45D 40/24* (2013.01); *B65D 25/42* (2013.01); *B65D 33/01* (2013.01); *B65D 85/72* (2013.01); *A45D 19/0066* (2021.01); *A45D 2200/052* (2013.01)

(58) Field of Classification Search

CPC ..... A45D 40/24; A45D 19/0066; A45D 2200/052; A45D 40/265; A45D 2200/058; A45D 19/026; A45D 19/00; A45D 2200/25; B65D 25/42; B65D 33/01; B65D 85/72;

(Continued)

(56) References Cited

U.S. PATENT DOCUMENTS 4,805,767 A * 2/1989 Newman ..... B65D 81/3266 206/219
5,203,459 A * 4/1993 Wade ..... A61J 7/0046 426/115

(Continued)

FOREIGN PATENT DOCUMENTS

KR 101620076 B1 5/2016

OTHER PUBLICATIONS

Purederm Press & MIX Creamy Hair Color Set 3 Color Simple 10 Min DIY Cover Gray, https://www.ebay.com/tm/172206873452?var=471039426887&hash=item2818545b6c:g:HngAAOSwYmZXNs7x, last visited Jun. 29, 2021.

(Continued)

*Primary Examiner* — Vishal Pancholi

(74) *Attorney, Agent, or Firm* — Cherskov Flaynik & Gurda, LLC

(57) ABSTRACT

One pouch for storage of multiple components of a mixture is described with a first compartment and a second compartment. At least one channel is defined between the first compartment and the second compartment and at least one seal is installed within the channel. An agitator is installed in the first compartment. The seal is breakable and the agitator is removable. Another pouch separates two pockets with an air compartment. The air compartment is breakable.

20 Claims, 7 Drawing Sheets

(58) Field of Classification Search
CPC . B65D 51/32; B65D 75/5883; B65D 81/3266
See application file for complete search history.

(56) References Cited

U.S. PATENT DOCUMENTS

| | | | | |
|---|---|---|---|---|
| 6,652,144 | B2 | 11/2003 | Stefandl | |
| 6,752,264 | B2 | 6/2004 | Versluys | |
| 9,567,147 | B2 * | 2/2017 | Park | B65D 81/3266 |
| 2002/0166779 | A1 | 11/2002 | Etesse et al. | |
| 2005/0072442 | A1 * | 4/2005 | Licari | A61Q 5/10 401/196 |
| 2006/0113318 | A1 * | 6/2006 | May | A45D 34/04 222/94 |
| 2007/0278114 | A1 | 12/2007 | Kane et al. | |
| 2008/0149526 | A1 * | 6/2008 | Sivakumar | A47L 13/17 206/568 |
| 2011/0182530 | A1 | 7/2011 | Park | |
| 2013/0327351 | A1 * | 12/2013 | Schatteman | A45D 19/012 132/208 |
| 2014/0004227 | A1 * | 1/2014 | Tran | A45D 37/00 426/112 |

OTHER PUBLICATIONS

PRESS'nMIX Men's Hair Color—Dark Brown, https://www.gobizkorea.com/mobile/mobileGoodsDetail.do?goods_no=GS2017111000227, last visited Jun. 29, 2021.

Adwin Korea Co., Ltd., One-step Hair Color pouch product, photographed on Mar. 24, 2020.

* cited by examiner

STORAGE POUCHES AND GRAY HAIR COVERAGE METHOD USE

The present invention claims priority as a non-provisional of U.S. provisional application Ser. No. 63/041,696, filed on Jun. 19, 2020, the contents of which are now incorporated by reference.

BACKGROUND OF THE INVENTION

1. Field of the Invention

The field of the invention is a system and method of storing a two-part composition. One embodiment is used to store and dispense contents such as hair coloring solution, including gray hair coloring, and preferably, a solution for gray hair coverage.

2. Background of the Invention

In various embodiments, the invention provides a device and method for storage and transfer of any two-part composition. In such a composition, two parts are stored in an inactive separated form. To be used, the two parts must be combined or mixed. Thus, the invention provides a convenient means of storage and subsequent mixing of two components in a single-use pouch.

In one embodiment, the invention comprises a pouch having two compartments and one applicator brush. Each compartment is hermetically sealed during storage, both from the outside atmosphere and from the opposing compartment, allowing for long-term storage. Thus, the end-user can dispense the two components and then retrieve the contents using the applicator brush without coming in contact with the pouch contents.

A need exists in the art for a device and method of mixing multiple components using a single and convenient device, especially for the convenient dispensing of hair coloring using an integral applicator brush. The hair coloring is optimized for coverage of gray hair. A benefit of one embodiment of the invention is that it allows for an easy way to cover gray hair using a permanent dye. In one embodiment, the system is a single piece with no need for additional products such as a bowl or brush. In one embodiment, the device facilitates the complete mixing of the hair color components and easy application with the applicator brush.

SUMMARY OF INVENTION

An object of the invention is to create a system and method to store and dispense a composition having multiple subparts. A feature of the invention, in one embodiment, is that it shows a pouch with multiple separated sub-parts allowing for independent storage of components. An advantage of the invention is that it allows for long-term storage of subparts of a composition.

Another object of the invention is to ensure the subparts of a composition are entirely dispensed without unintended contact. A feature of the invention is that at least one chamber in the storage pouch includes an applicator brush. An advantage of the invention is that it provides single-piece storage and a dispensing system where the end-user does not require any external tools.

Yet another object of the invention is to provide a storage device where the end-user does not contact any of the composition components or mixed composition. A feature of the invention is that each of the chambers containing a component is sealed from one another, and the end-user using a non-bonding line. An advantage of one embodiment is that the end-user can mix the components without contacting the same with his or her hand.

A further object of the invention is to provide a flexible storage container. A feature of the invention is that in one embodiment, each pouch comprises a flexible material, such as a multi-layered film. An advantage of the system is that the storage pouches can be deformed without unintentionally breaking the seal between the chambers.

An additional object of the invention is to allow for the dispensing of subcomponents immediately after mixing. A feature of the invention is that one of the chambers includes an applicator brush already present in one of the components in one embodiment. An advantage of the system is that mixing can begin immediately after breaking the seal between the chambers.

A packing device for storage of compositions having multiple components is described along with a method of use of the same. The device includes multiple chambers and an applicator brush in one of the chambers, per one embodiment of the invention. The applicator brush facilitates the dispensing of the mixed components.

BRIEF DESCRIPTION OF DRAWING

The invention, together with the above and other objects and advantages, will be best understood from the following detailed description of the preferred embodiment of the invention shown in the accompanying drawings, wherein.

DETAILED DESCRIPTION OF THE INVENTION

The preceding summary and the following detailed description of certain embodiments of the present invention will be better understood when read in conjunction with the appended drawings.

To the extent that the figures illustrate diagrams of the functional blocks of various embodiments, the functional blocks are not necessarily indicative of the division between distinct steps, some of which may be combined.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
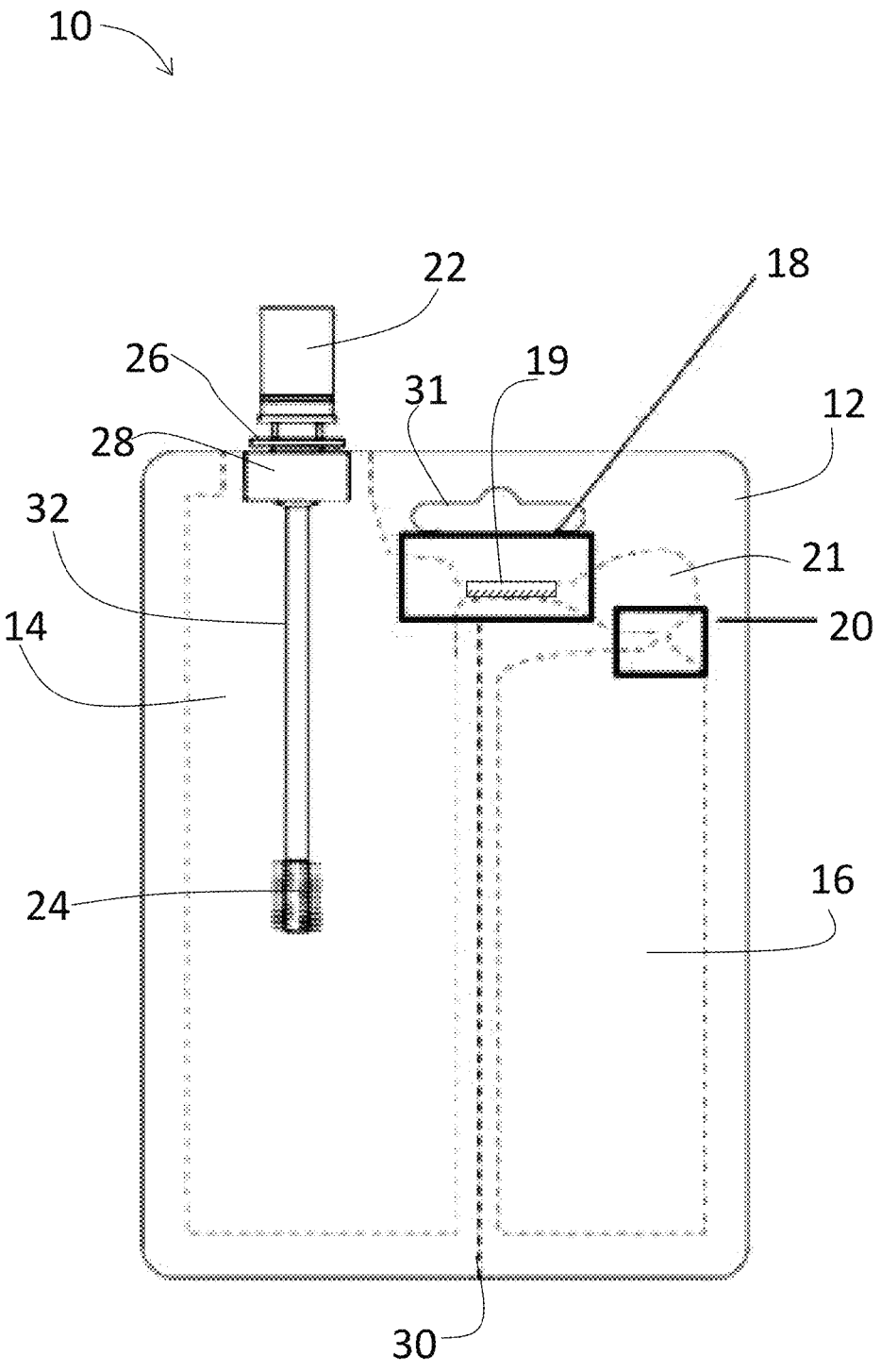
FIG. 1 depicts an overview of one embodiment of the invention.

Turning to FIG. 1, shown therein is an embodiment 10 of the storage pouch 12. The storage pouch 12 comprises a multi-layer lined polymer in one embodiment. For example, the pouch 12 is made from an extruded film having the following layers, listed in order from the outer layer to the inner layer—Polyethylene terephthalate (PET), followed by aluminum film, followed by a layer of nylon, and finally Linear Low Density Polyethylene (LLDPE). In another embodiment, the layers are PET, then aluminum, then nylon, and an appropriate barrier layer. Other materials include PET plastic lined with a layer of aluminum. The composition of the pouch 12 is adapted to prevent reactions with the contents of the pouch while remaining pliable.

Further, the pouch 12 resists both puncture and impact. In most embodiments, the pouch 12 includes four layers, including an outer layer of PET, followed by aluminum, nylon, and an internal layer of LLDPE. In another embodiment, the pouch includes an outer layer of PET followed by aluminum, nylon, and an internal lining layer.

The interior of the pouch is divided into several chambers or compartments, such as the first chamber or compartment 14, and the second chamber or compartment 16 shown in the embodiment of FIG. 1. In other embodiments, additional compartments are present. For example, in one embodiment, the second compartment 16 is further divided into additional compartments.

In one embodiment, both the first compartment 14 and the second compartment 16, contain approximately 10 grams of contents, each.

The first compartment includes an extension channel 18. The extension channel is initially sealed with a block of sealing material 19. The material 19 is initially sealed in the channel 18 but can be dislodged from the channel 18 by squeezing the pouch 12. In one embodiment, the sealing material 19 comprises additional bulk of the interior layers of the pouch. The material forms a seal with the application of pressure and temperature on the outside of the pouch. In one embodiment, a sealing machine is used to form the block of material. The seal is formed using a heated iron, having a shape corresponding to the required locations of the seals. In one embodiment, the entire iron is heated, but it includes a recessed space in the middle of the plate. In this embodiment, heat is applied at the pouch edge, where the heated iron segments contact the film.

While in FIG. 1, the sealing material 19 is shown as a regular rectangle, in other embodiments, not shown, the sealing material 19 forms a variety of shapes designed to conform to the channel 18. The sealing material 19 is designed to be dislodged with sufficient pressure. When pressure is applied to one side of the pouch, the material 19 leaves the channel 18, and the channel 18 is opened. If the material 19 appears to be stuck in the channel 18 (as can be determined by manual examination of the exterior of the pouch), the exterior of the pouch can be kneaded or otherwise manipulated to dislodge the material 19 from the channel 18. The channel 18 and the sealing material 19 form a pressure-sensitive seal.

The channel 18 is in fluid communication with the outlet 20 of the second compartment 16; however, it is not in direct communication in some embodiments. In the embodiment of FIG. 1, the channel 18 opens to an intermediate cavity 21. The intermediate cavity 21 ensures that material from the second chamber 16 does not flow too quickly into the channel 18, even if significant pressure is applied to the main body of the pouch 12.

The intermediate cavity 21 is, in turn, in fluid communication with the interior of the second chamber 16.

With the sealing material 19 removed, the contents of the second chamber 16 will be in fluid communication with the contents of the first chamber 14 by passing through the outlet 20 into the cavity 21 and then through the channel 18. In one embodiment, none of these structures restrict the directionality of the flow. Therefore, the contents of the first chamber 14 will mix with the second chamber 16 by passing through the same structures. The source chamber and the destination chamber will be determined by which chamber experiences higher external pressure.

In one embodiment, the intermediate cavity 21 acts as a type of additional safety pressure-relief cavity or device. The pressure-relief cavity is in communication with both the first compartment 14 and the second compartment 16, in one embodiment. In other embodiments (not shown), multiple pressure-relief cavities are defined in the interior. When used by consumers, the contents of both chambers are mixed through the channel 18. The sealing material 19 is dislodged by rubbing the exterior of the packaging in one embodiment. If high pressure is applied in one of the chambers, the intermediate cavity 21 will slow down the flow between the chambers, rather than potentially rupturing the channel 18. The intermediate cavity 21 also prevents unintentional mixing in one embodiment. If the sealing material 19 does not form a uniform seal within the channel 18, liquid from the chambers will not come in contact unless pressure is applied to the exterior, as the intentional application of pressure is required for the contents of each chamber to traverse the intermediate cavity 21.

In one embodiment, one chamber is designed to be more flexible than the other chamber. The contents of the more flexible chamber will then exit to the less flexible one.

In another embodiment, both chambers comprise the same material, but the exterior of one chamber includes instructions to apply pressure in that chamber.

The pouch 12 is therefore designed to allow for storage of the contents of the first chamber 14 and the second chamber 16 without mixing of the two contents until the sealing material 19 is compromised. In one embodiment, the sealing material is forced out of the channel 18 by squeezing the exterior of the pouch 12 corresponding to the interior location of the channel 18. Once deformed, the material 19 will leave the channel 18 along with the contents of the second chamber 16 as soon as external pressure is applied to the second chamber 16.

Figure 2:
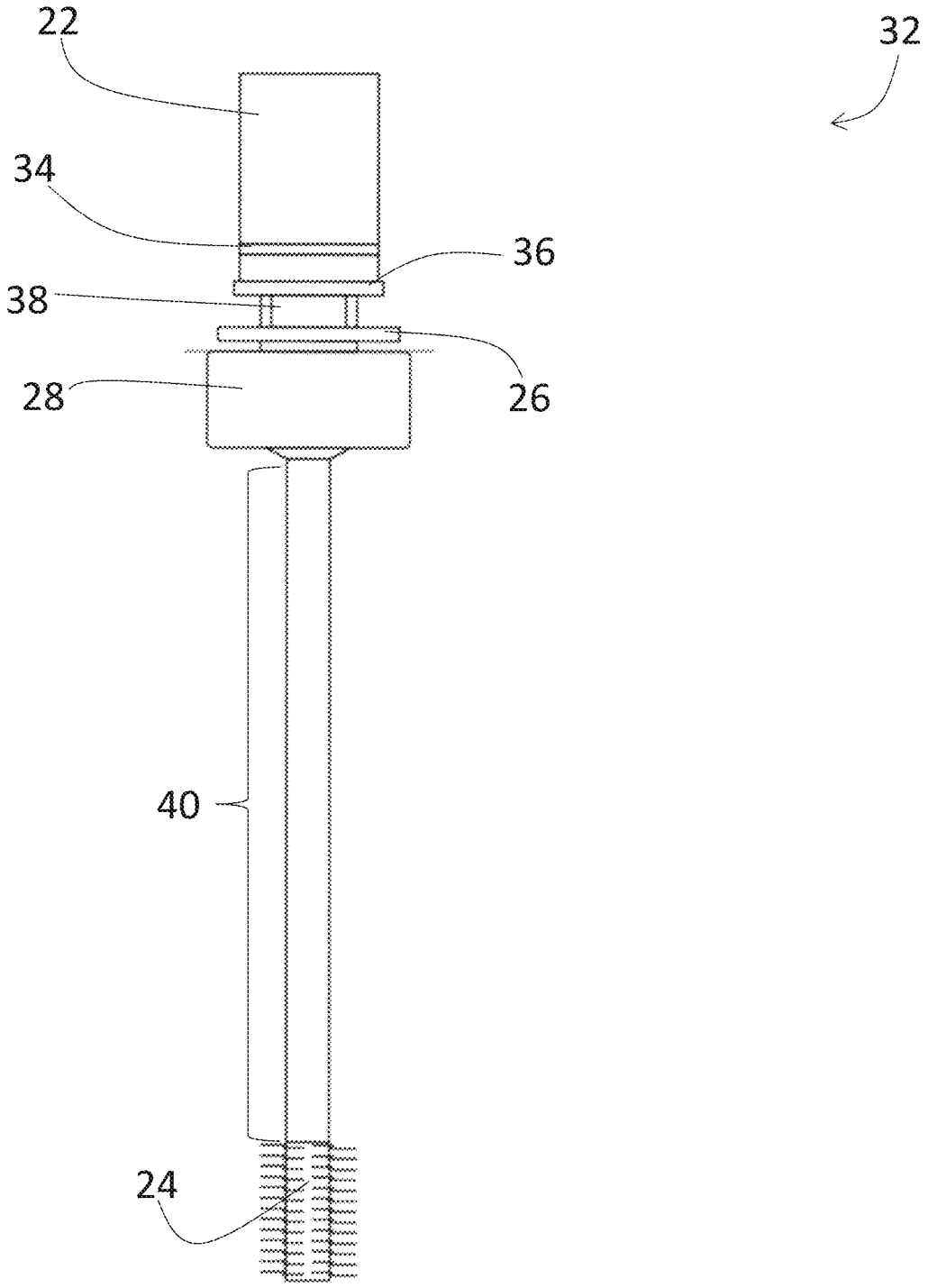
FIG. 2 depicts a second overview of one embodiment of the invention.

The first chamber 14 includes a dispensing tool, such as the brush 32 shown in FIGS. 1 and 2. The brush 32 includes a first end with a cap 22 and a second end with an agitator 24. The cap 22 acts as a holder, in one embodiment, as well as a way to securely attach the brush 32 to the pouch 12. The cap 22 includes at least one tamper-evident element, such as shrink-wrap or a break-away plastic piece, in one embodiment.

The cap 22 includes a threaded portion (not visible in FIG. 1), which is received by a nut 28 embedded in an outer surface of the pouch 12. The nut 28 is in communication with the interior of the first chamber 14, in one embodiment. The interior of the nut 28 is in fluid communication with the interior of the first chamber 14.

To ensure that the pouch 12 does not leak from the brush 32, at least one seal 26 is added.

In one embodiment, the exterior of the pouch 12 includes a printed layer, including a full-color photograph showing the contents and instructions for the use of the pouch 12.

In the embodiment shown in FIG. 1, the pouch 12 includes a perforation 30. The perforation 30 allows the end-user to locate the dividing line between the first chamber 14 and the second chamber 16. The perforation 30 also acts as a quality control measure in one embodiment. If either chamber 14, 16 is not entirely sealed, the contents will not mix with the other chamber. Instead, the contents will leak out to the outside. Further, the perforation 30 acts as a safety device. If excessive pressure is applied to either chamber, the contents will exit through the side and to the exterior of the pouch 12, rather than mixing with the contents of the other chamber.

The exterior of the pouch 12 includes at least one perforated area 31 to allow for hanging of the completed pouch on a display rack.

The embodiments shown are also particularly advantageous for display at the point of sale. The perforated area 31 allows the package to be made available for direct purchase by end customers from the point of sale display, such as a pegboard.

Brush Details

Turning to FIG. 2, the details of the brush 32 are shown there. The cap 22 includes at least one cap band 34 to help in turning the cap 22, especially the first time the pouch is opened and the tamper-evident features must be broken. The cap 22 ends in a base 36. Extending out of the base 36 is the brush shank 38. The shank includes a plain portion and a threaded portion (not shown). The threaded portion is received by corresponding threads in the nut 28 after passing through the seal 26.

The shank portion inside of the pouch 40 is thinner than the exterior shank 38. The interior portion 40 ends with the agitator portion 24, which includes bristles in the embodiment shown in FIG. 2. Other embodiments of the agitator portion 24 include a variety of elements, such as the embodiment shown in FIG. 4A.

Use

Figure 3:
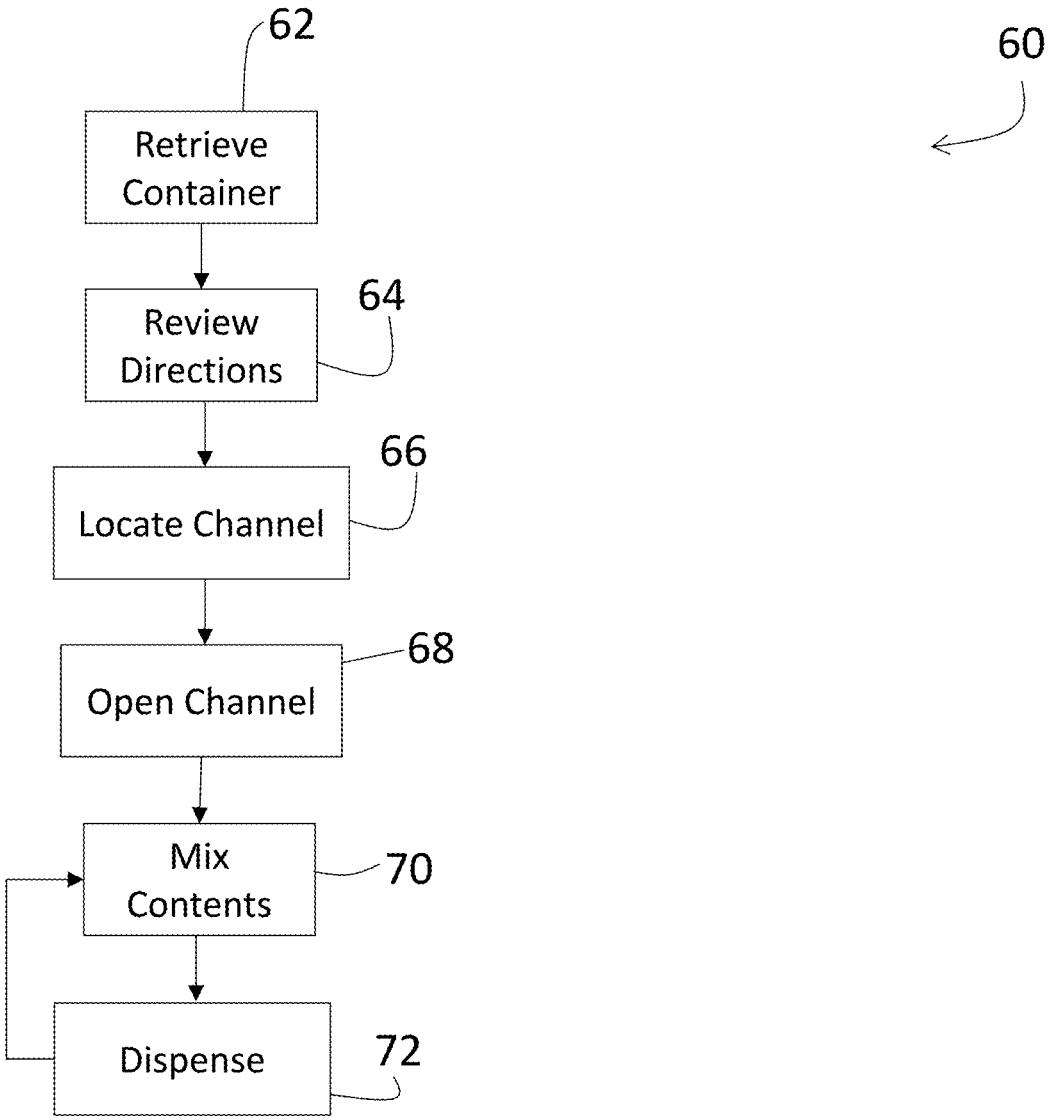
FIG. 3 depicts a flow chart of the method of use of one embodiment of the invention.

As shown in FIG. 3, during use 60 of the pouch, the end-user must first retrieve the container 62. Next, the end-user should review the directions 64 and locate the interior channel 66. The end-user should then follow directions to open channel 68 and commence mixing the contents 70 of the container. Using the dispensing tool, the end-user should then dispense 72 the contents, returning to the mixing step as needed.

As described above, in several embodiments, the device is particularly advantageous in use for storing hair dye. The embodiment provides a single-piece device, and the end-user does not need to supply their own mixing bowl or brush as all of the necessary components are provided in one kit.

In one embodiment, the invention provides a way to mix all of the components of the hair coloring product, including the base cream, the color precursors, the dyes, and the various agents such as ones for alkalizing, caring, and complexing. The end product is a single-piece device that maximizes end-user convenience and eliminates the possibility of spilling of contents both during mixing and dispensing.

In one embodiment, the pouch chambers store the color developer and color base. The color developer includes an oxidizing agent, such as peroxide, that is designed to help open the hair cuticle so that the dye can react with the cortex or inner part of the hair follicle. The color base is a substance containing the coloring dye that will react with the color developer to either add or remove color to the hair.

Agitator Details

Figure 4A:
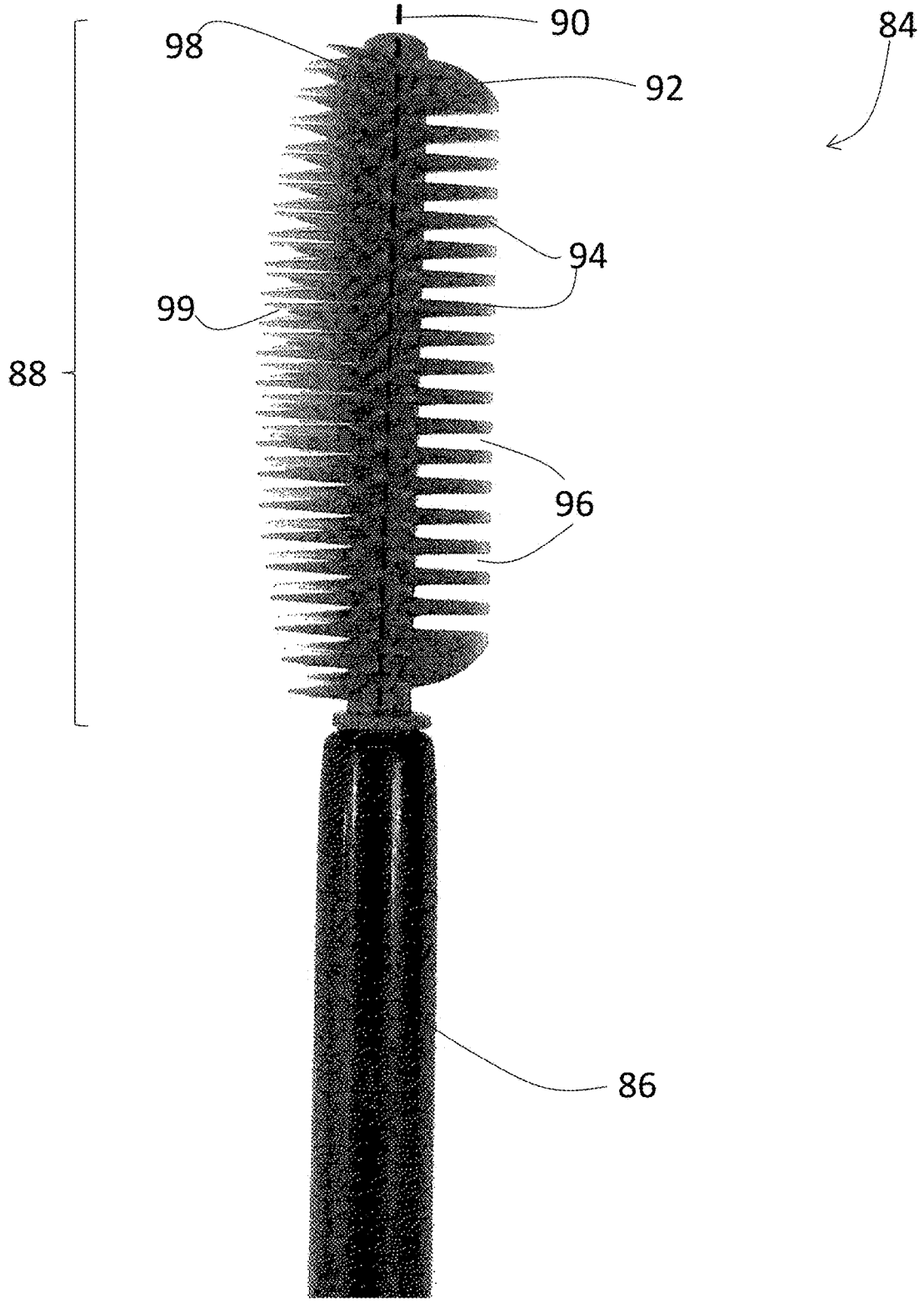
FIG. 4A depicts a detailed view of a component of an embodiment of the invention.

FIG. 4A shows a detailed view of an embodiment of the agitator portion 84, which is suitable for use in place of the brush-based agitator (shown as agitator 24 in FIGS. 1 and 2).

The agitator portion 84 comprises a shank 86 and a head 88. The head 88 includes various mixing and dispersal implements. As shown in FIG. 4A, the head 88 includes an axis 90, and the implements are perpendicular to the axis 90.

As shown in FIG. 4A, one of the implements is a comb-type structure 92. The comb comprises teeth 94, which are separated by spaces 96. The spaces 96 are narrower closer to the axis 90 and wider away from the axis 90. The spaces 96 are approximately 125% the size of the teeth 94.

The comb-type structure 92 is adapted to easily pass through the hair with a coarse texture, such as hairs found in a beard or a mustache. The comb-type structure 92 evenly distributes the mixed product onto hair and creates desirable results.

The second side of the agitator head 88 includes a brush-type structure 98 with finer bristles 99. The bristles 99 extend from a wider base to a pointed tip, also away from the head 88 central axis 90. While the teeth 94 of the comb-type structure 92 were substantially coplanar and aligned in a row, the bristles 99 are arranged at differing angles and are not coplanar. The brush-type structure 98 is adapted for detailed application of hair substance, such as on sides of the hair, on roots, and on short hair segments, such as on men's hair.

The head 88 implements are therefore designed for different types of applicators. As each implement is on its own side of the head 88, they can be used independently.

The implements also help during the mixing process, such that both the comb-type structure 92 and the brush-type structure 98 help in the mixing of the components.

Figure 4B:
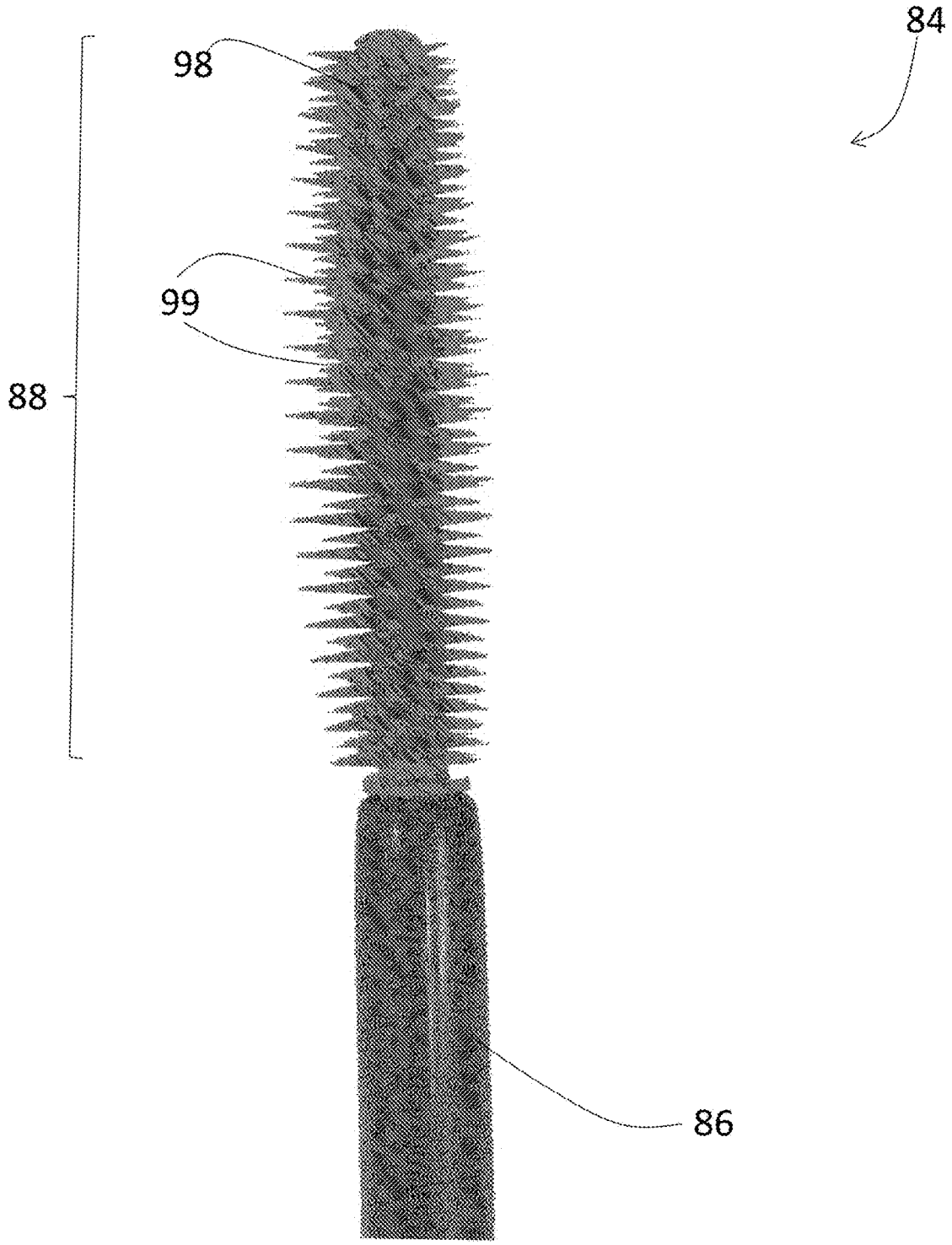
FIG. 4B depicts another detailed view of a component of an embodiment of the invention.

FIG. 4B shows a rotated view of the embodiment of the agitator portion 84. In the view of FIG. 4B, the comb-type structure is not visible, and instead, only the brush-type structure 98 with its bristles 99 is visible.

As can be appreciated from the view in FIG. 4B, the bristles 99 have a variety of shapes and sizes, but most are substantially rectangular.

In one embodiment, the head 88 is removable from the shank 86. In other embodiments, the head 88 is integrally molded with the shank 86. In embodiments where the head 88 is removable, the implements on the head 88 can be customized to best match the substance being mixed and dispensed by the system.

Alternative Pouch

Figure 5A:
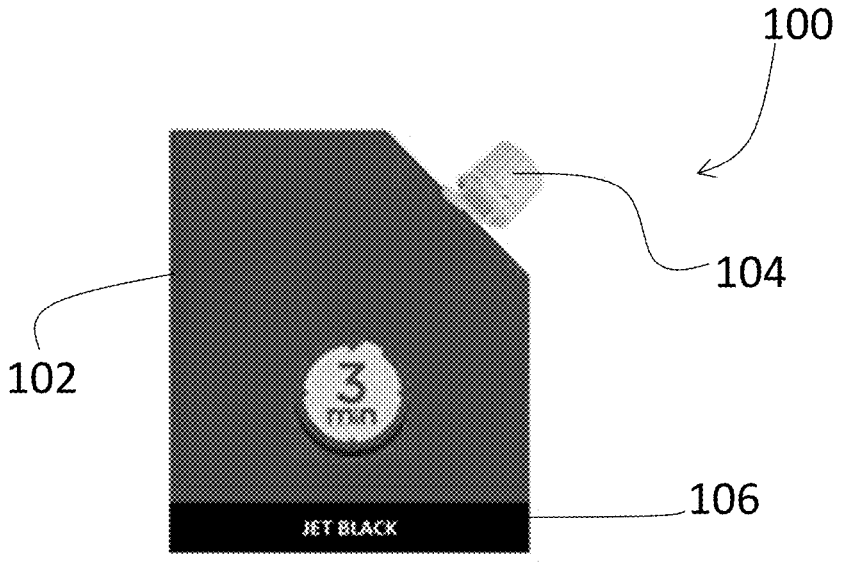
FIGS. 5A-C depict an alternative embodiment of a pouch and method of use.

An alternative multi-layer embodiment 100 is shown in FIG. 5A. The multi-layer embodiment 100 includes a main body 102 and an exit spout 104. The exit spout 104 may include an agitator pre-installed, much as the embodiments discussed above. In other embodiments, the exit spout 104 comprises a twist-off cap, and the agitator is provided separately, such as by attaching the agitator to the underside of the main body 102. The embodiment shown in FIG. 5A uses a main body 102 with a substantially rectangular shape, except for the exit spout 104. The main body 102 includes a color indication area 106, in the depicted embodiment 100. The embodiment 100 is adapted to dispense mixed hair coloring dye, as was the case with other embodiments, it is suitable to dispense any two-part product.

Figure 5B:
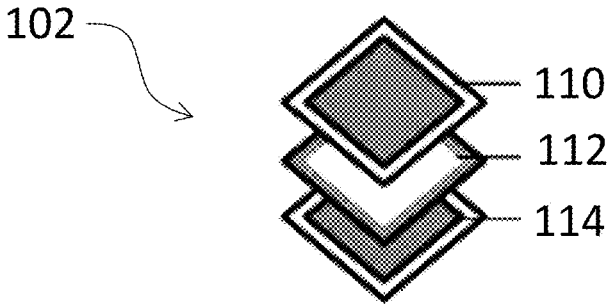

A schematic view of the interior of the main body 102 is shown in FIG. 5B. The main body 102 comprises three pockets 110, 112, 114. The contents of each pocket is initially separated. In the embodiment shown in FIG. 5B, the first pocket 110 comprises a color base, the second pocket 112 contains air, and the third pocket 114 contains a developer solution.

The walls of each pocket are variable, in one embodiment. For example, the internal walls are weaker than the external walls. As can be appreciated from the drawings, the internal walls are the ones between the second pocket 112 and the other two pockets 110 and 114.

Figure 5C:
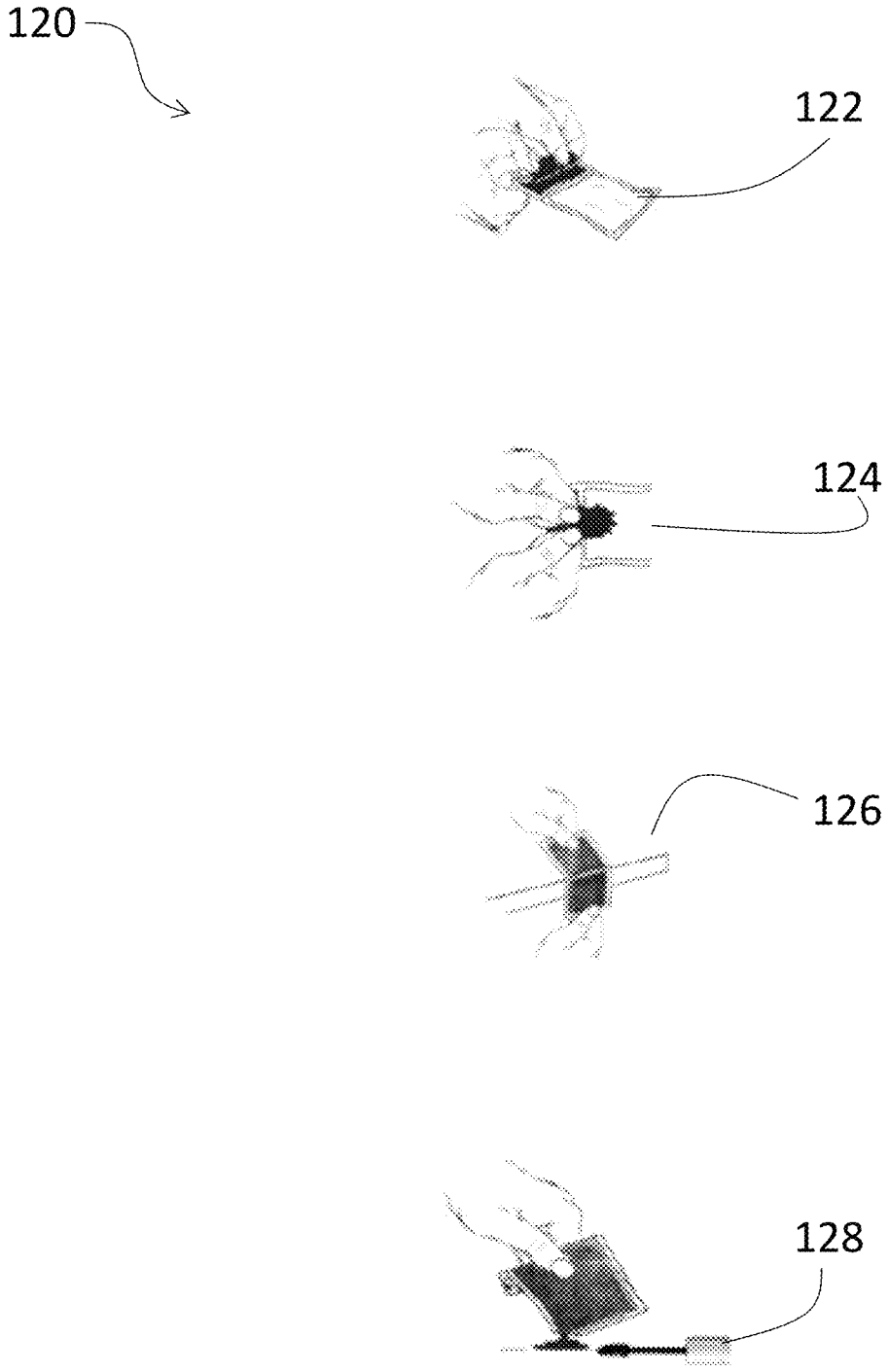

The steps of using 120 of the embodiment are shown in FIG. 5C. In the rolling step 122, the pouch is rolled forward to burst the seal. The color indication area 106 is used to start the rolling step 122 in one embodiment.

Next, in the rupturing step 124, the end-user will apply pressure to rupture the seal fully. The end-user may use their finger to rupture the seal in one embodiment. Audible feedback is provided in one embodiment. As the interior walls rupture before the exterior walls, the interior air pocket is breakable without the contents of the pockets leaving the pouch.

Next, in the mixing step 126, the end-user will thoroughly mix the components. As shown in FIG. 5C, the mixing may be performed by running the pouch on the corner of a table, in one embodiment. Finally, in the dispensing step 128, the end-user will apply the mixed product onto the hair with the applicator.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

The invention claimed is:

1. A pouch for storage of multiple components of a mixture comprising:
- a first compartment;
- a second compartment;
- at least one channel between the first compartment and the second compartment;
- at least one sealing material within the channel; and
- an agitator installed in the first compartment;
- wherein said seal is breakable and said agitator is removable;
- wherein the first compartment and the second compartment are hermetically sealed after filling.

2. A pouch for storage of multiple components of a mixture comprising:
- a first compartment;
- a second compartment;
- at least one channel between the first compartment and the second compartment;
- at least one sealing material within the channel; and
- an agitator installed in the first compartment;
- wherein said seal is breakable and said agitator is removable;
- wherein said agitator comprises a brush which includes bristles used to dispense contents of the pouch.

3. The pouch of claim 2 wherein said bristles are also used to assist in dispensing the contents of the first compartment with the second compartment.

4. The pouch of claim 2 wherein said brush includes at least one set of bristles.

5. The pouch of claim 2 wherein said pouch comprises a flexible material.

6. The pouch of claim 2 further comprising a perforation between the first compartment and the second compartment.

7. The pouch of claim 2 further comprising at least one pressure-relief cavity in communication with both the first compartment and the second compartment.

8. The pouch of claim 2 wherein said channel comprises a pressure-relief cavity.

9. The pouch of claim 2 wherein said pouch comprises layers of PET, Aluminum film, Nylon, and LLDPE.

10. The pouch of claim 2 further comprising additional compartments.

11. The pouch of claim 2 wherein said agitator comprises an agitator head having a plurality of mixing and distributing components.

12. The pouch of claim 11 wherein said components comprise a comb-type structure and a brush-type structure.

13. The pouch of claim 11 wherein said components are distributed around a central axis and are adapted for independent use.

14. A pouch for storage of multiple components of a mixture comprising:
- a first compartment;
- a second compartment;
- at least one air pocket separating the first compartment and the second compartment; and
- an agitator attached to the pouch;
- wherein said air pocket is breakable and said agitator is removable.

15. The pouch of claim 14 further comprising an exit spout in fluid communication with an interior of at least one compartment of the pouch.

16. The pouch of claim 15 wherein said agitator is initially installed in the spout.

17. The pouch of claim 14 wherein the first compartment comprises a color base, and the second compartment contains a developer solution.

18. The pouch of claim 17 further comprising a color indication area.

19. The pouch of claim 14 wherein internal walls within the pouch are weaker than external walls of the pouch.

20. The pouch of claim 14 wherein said pouch is adapted for mixing of contents of the first compartment and the second compartment once the air pocket is ruptured.

* * * * *